United States Patent [19]

Bashford

[11] Patent Number: 4,506,878

[45] Date of Patent: Mar. 26, 1985

[54] DUAL DIRECTIONAL DOCUMENT DRIVE APPARATUS

[75] Inventor: Anthony J. Bashford, Baden, Canada

[73] Assignee: NCR Corporation, Dayton, Ohio

[21] Appl. No.: 392,481

[22] Filed: Jun. 28, 1982

[51] Int. Cl.[3] ..... B65H 7/02

[52] U.S. Cl. ..... 271/227; 271/31.1; 271/149; 271/251; 271/265; 271/272

[58] Field of Search ..... 271/8 A, 227, 250, 251, 271/265, 273, 272

[56] References Cited

U.S. PATENT DOCUMENTS

| | | | |
|---|---|---|---|
| 2,767,982 | 10/1956 | Noon | 271/251 |
| 3,175,824 | 3/1965 | Albosta | 271/251 |
| 3,360,099 | 12/1967 | Barr | 198/21 |
| 3,779,546 | 12/1973 | Wojtowicaz et al. | 271/196 |
| 3,964,739 | 6/1976 | Garcia | 271/3 |
| 4,214,740 | 7/1980 | Acquaviva | 271/3 |
| 4,224,508 | 9/1980 | Kao | 235/437 |
| 4,362,298 | 7/1982 | Stefansson | 271/251 X |

FOREIGN PATENT DOCUMENTS

| | | | |
|---|---|---|---|
| 376554 | 7/1932 | United Kingdom | 271/250 |

OTHER PUBLICATIONS

IBM Technical Disclosure Bulletin, vol. 19, No. 9, p. 3499, Feb. 1977, "Document Aligner", F. M. Diel et al.

*Primary Examiner*—Richard A. Schacher
*Attorney, Agent, or Firm*—J. T. Cavender; Albert L. Sessler, Jr.; Elmer Wargo

[57] ABSTRACT

A sheet moving apparatus comprising: a track having first and second spaced side walls and a third wall therebetween to form a sheet receiving space therebetween; and a sheet feeder for moving a sheet towards the third wall and thereafter moving the sheet in a downstream direction along the track. The sheet feeder comprises a rotatable member having a surface positioned in the sheet receiving space and a rotary drive enabling the rotatable member and its surface to be rotated. The sheet feeder also includes a rotatable or pivotal member moveable between first and second positions with regard to the rotatable member, with the pivotal member having a roller member to cooperate with the surface of the rotatable member to move a sheet towards the third wall when the pivotal member is in the first position, and the rotatable member and its surface are rotated. The pivotal member also cooperates with the surface of the rotatable member to move the sheet in the downstream direction when the pivotal member is pivoted to the second position and the rotatable member and its surface are rotated. An actuator and a resilient member are used for moving the pivotal member between the first and second positions.

5 Claims, 7 Drawing Figures

DUAL DIRECTIONAL DOCUMENT DRIVE APPARATUS

CROSS-REFERENCE TO RELATED APPLICATIONS

This application is related to U.S. application Ser. No. 334,510 which was filed on Dec. 28, 1981 and is assigned to the same assignee as is the present application.

BACKGROUND OF THE INVENTION

This invention relates to a dual-directional, document-drive apparatus which has the purpose of feeding or lowering a document in a track first, and thereafter, feeding or moving the document in a downstream direction in said track.

In certain document handling apparatuses, the documents are hand fed, for example, into a track to be moved downstream in the track to a utilization device such as a printer or encoder. In certain such utilization devices, it is necessary to get the document oriented in a certain way within a very short distance as measured in a downstream direction along the track. With prior art document feeding apparatuses, it was difficult to obtain the desired orientation of the document within a short distance as measured in the downstream direction mentioned.

SUMMARY OF THE INVENTION

A preferred embodiment of the document or sheet moving apparatus of this invention comprises: a track having first and second spaced side walls and a third wall therebetween to form a U-shaped, sheet-receiving space therebetween; and means for moving a sheet towards said third wall and thereafter moving said sheet in a downstream direction along said track comprising: a rotatable member having a surface positioned in said sheet receiving space and means enabling said rotatable member and its surface to be rotated; a moveable member and means enabling said moveable member to pivot between first and second positions with regard to said rotatable member; said moveable member having an engaging member to cooperate with said surface of said rotatable member to move a sheet towards said third wall when said moveable member is in said first position and said rotatable member and its surface are rotated, and said engaging member of said moveable member being enabled to cooperate with said surface of said rotatable member to move said sheet in said downstream direction when said moveable member is pivoted to said second position and said rotatable member and its surface are rotated; and drive means for pivoting said moveable member between said first and second positions.

An advantage of the present invention is that it can orient a document or sheet by having the lower edge of the sheet contact the "bottom" of the track before it is advanced in a downstream direction.

Another advantage is that the apparatus of this invention is of simple construction and is inexpensive to produce and easy to maintain.

These advantages and others will become more readily understood in connection with the following specification, claims, and drawing.

BRIEF DESCRIPTION OF THE DRAWING

FIG. 2 is taken along the line 2—2 of FIG. 1;

DETAILED DESCRIPTION OF THE INVENTION

Figure 1:
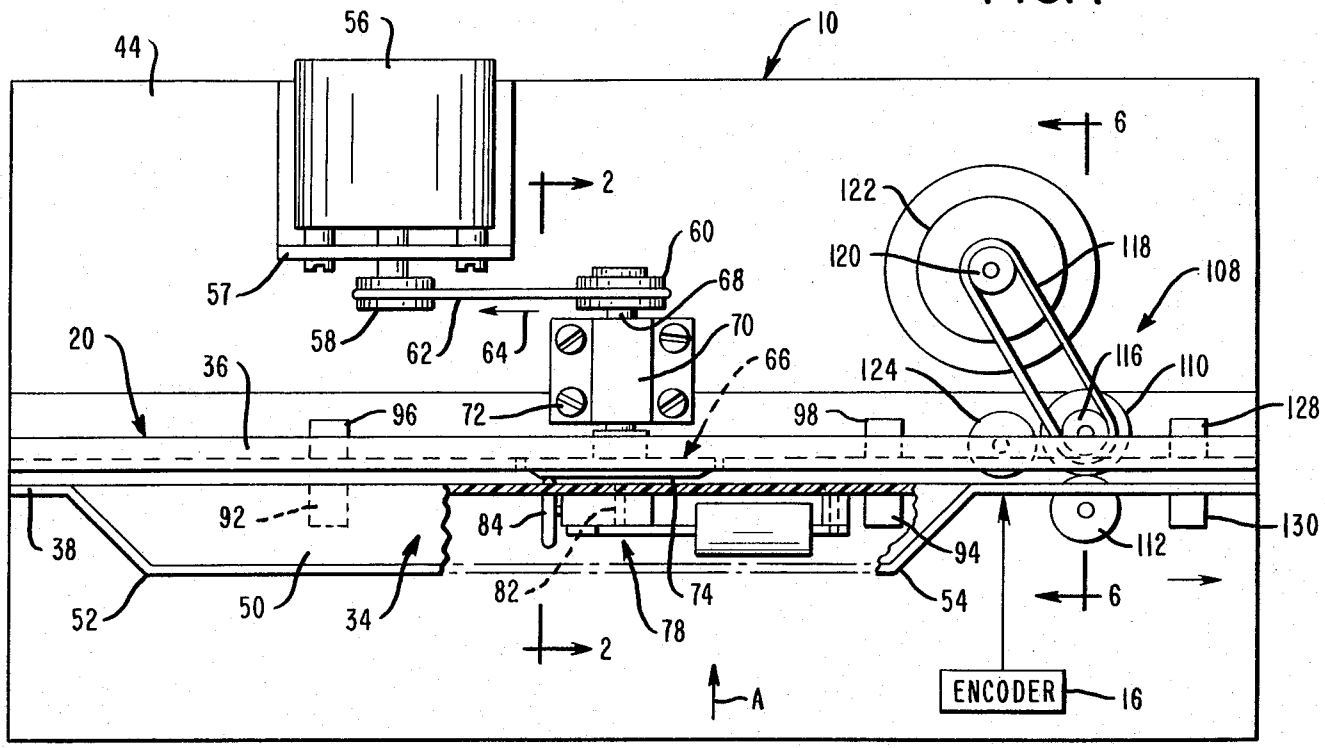
FIG. 1 is a plan view of a document-moving track in which a preferred embodiment of the dual directional document drive apparatus of this invention is located.

FIG. 1 is a plan view of a preferred form of the document drive apparatus of this invention which is designated generally as 10. Before discussing the details of the apparatus, it appears useful to explain how the apparatus 10 is used.

In certain operations, it is necessary to orient a document or sheet prior to moving it to a utilization device, as stated earlier herein. For example, it may be necessary to orient a document or sheet so that its lower-most edge contacts the bottom of a track so that encoding or printing may occur at a fixed distance above the lower-most edge of the document. In one of those operations, it is necessary that the orienting of the document be accomplished within a very short distance as measured along the downstream direction of the track. The present invention is especially adaptable for such an operation or application although its use may be extended to other feeding operations.

Figure 6:
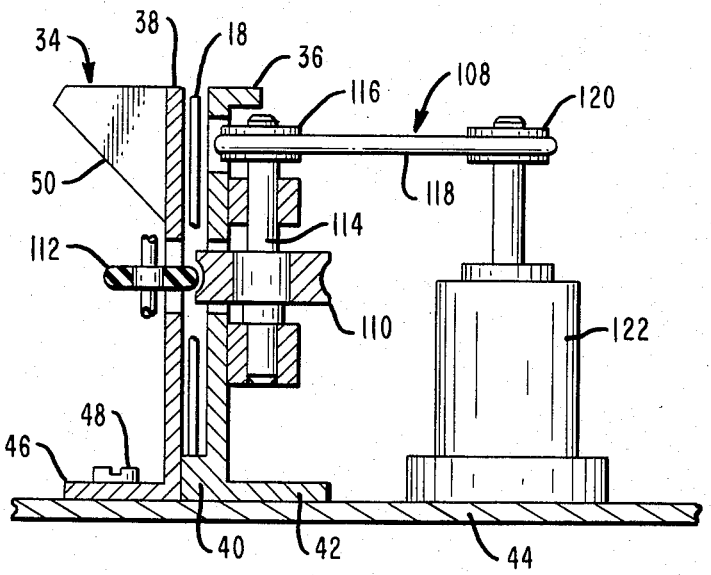
FIG. 6 is a cross-sectional view, taken along the line 6—6 of FIG. 1 to show additional details of the means for feeding a document in a downstream direction.
Figure 7:
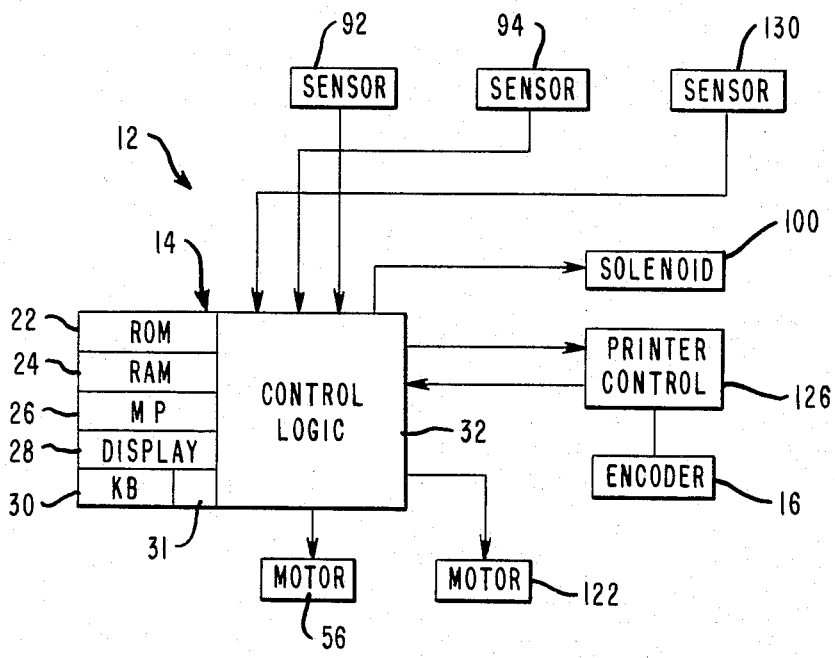
FIG. 7 is a schematic diagram, in block form, showing a control means which may be used with this invention.

The apparatus 10 may be incorporated in a terminal 12, only portions of which are shown diagrammatically in FIG. 7. The terminal 12 includes a control means 14 and a printer or encoder 16. One of the functions of the encoder 16, also shown in FIG. 1, is to print or encode certain data on a document or sheet like 18 (FIG. 6) which is moved along a guiding means or track designated generally as 20. The documents or sheets may be bank checks or invoices, for example, which are to have certain monetary amounts printed or encoded thereon in characters or bar codes, for example, at the encoder 16.

The control means 14 (FIG. 7) for controlling the operation of the terminal 12 may be conventional and includes a read only memory (ROM) 22 (in which instructions or programs are stored), a random access memory (RAM) 24, a processor such as a microprocessor (MP) 26, a display 28 for communicating with a user of the terminal 12, a keyboard (KB) 30 for entering data, and conventional control logic 32 which contains the appropriate logic circuitry and interfaces which enable the terminal 12 to function as what is considered an "intelligent" terminal. Because the control means 14 may be conventional, it need not be described in any further detail herein.

In a typical use of the apparatus 10, an operator of the terminal 12 enters on the keyboard 30 (FIG. 7) the monetary amount to be applied to or encoded on a document or sheet 18 in the example previously described. The operator then depresses an actuation key 31 on the keyboard 30 to initiate the operation of the apparatus 10, and thereafter, the operator drops the sheet 18 (with the long bottom edge of the sheet lowermost) into a receiving area 34 associated with the track 20 (FIG. 1).

The track 20 (FIG. 1) is made up of a first sidewall 36 and a second side wall 28 as best seen in FIG. 6, for example. The first side wall 36 has a third wall or bottom 40 and a flange 42 to enable it to be secured to the mounting plate 44 of the apparatus 10. The second side wall 38 has a flange 46 to enable it to be secured to the mounting plate 44 by fasteners like 48. The sheet receiving area 34 (FIG. 1) is formed by having a portion 50 of the second side wall 38 extend outwardly as shown in FIG. 6. In the embodiment described, the length of the receiving area 34, as viewed from the top as seen in FIG. 1, is about six inches as measured between corner bends 52 and 54; accordingly, the apparatus 10 handles or receives a sheet like 18 having a length of six inches or less with a height of about four inches as viewed in FIG. 6. Naturally, these dimensions could be changed to suit particular applications.

When the actuation key 31 (FIG. 7) is actuated, it energizes the motor 56 via the control logic 32. The motor 56 is part of the apparatus 10 shown in FIG. 1 and is secured to the mounting plate 44 via a bracket 57.

The motor 56 has an output pulley 58 which is drivingly coupled to pulley 60 by an endless belt 62, with the motor 56 being operated to move or drive the belt 62 in the direction of arrow 64.

The apparatus 10 also includes a rotatable member which will be referred to hereinafter as disc 66. Disc 66 has one end of a shaft 68 (FIG. 1) secured thereto, and the shaft 68 extends therefrom and is mounted in a bearing support 70 which is secured to the mounting plate 44 by fasteners 72. The remaining end of the shaft 68 has the pulley 60 secured thereto to enable the shaft 68 and the disc 66 to be rotated by the motor 56.

The disc 66 (FIGS. 1 and 2, for example) is inserted through an opening in the sidewall 36 and is positioned so that its circular, planar surface 74 extends about halfway into the space 76 between the side walls 36 and 38. When the motor 56 is energized, the disc 66 and its planar surface 74 are rotated in a counterclockwise direction as viewed from the direction A shown in FIG. 1.

Figure 2:
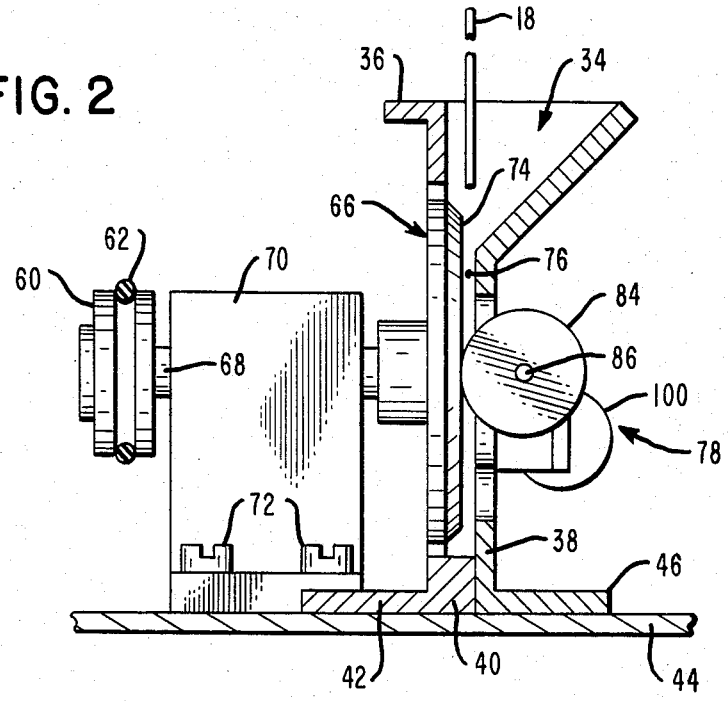
FIG. 2 is an elevational view, looking down-stream in the track and showing the drive apparatus in a first position from which a document is driven towards the base of the track.
Figure 3:
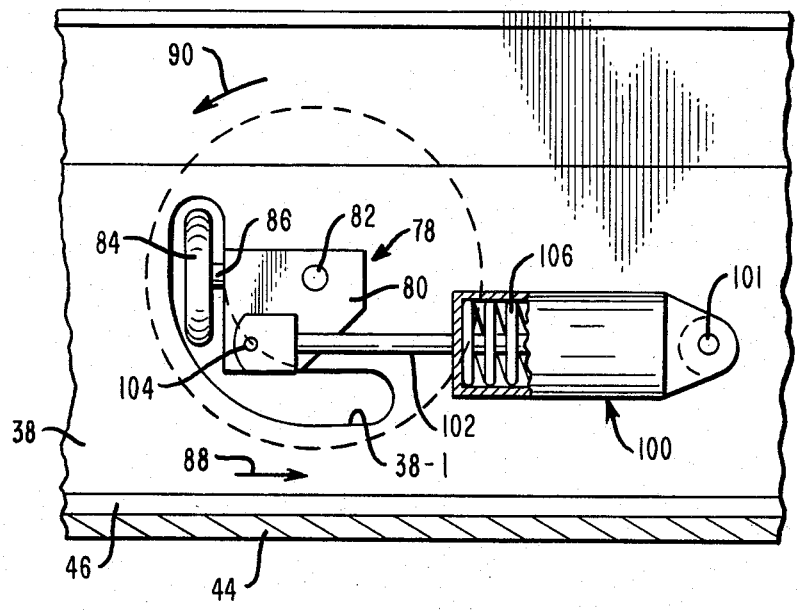
FIG. 3 is a side elevational view which is taken from the direction of arrow A in FIG. 1 to show additional details of the drive apparatus.

The apparatus 10 also includes a moveable or pivotal member designated generally as 78 and shown in FIGS. 1, 2 and 3, for example. The pivotal member 78 is moveable between a first position shown in FIG. 3 and a second position shown in FIG. 5. The pivotal member 78 includes a body 80 which is pivotally mounted on the side wall 38 by a pin 82 whose longitudinal axis is coincident with the rotating axis of disc 66 and the shaft 68. The pivotal member 78 also has an engaging member such as a pinch roller 84 which is positioned thereon to enable the periphery of the roller 84 to engage the surface 74 on the disc 66. The disc roller 84 is rotatably mounted on a rod 86 which is supported in the body 80 of the pivotal member 78.

When the pivotal member 78 is in the first position shown in FIG. 3, the longitudinal axis of rod 86 lies in an imaginary plane which is parallel to the planar surface 74 of the disc 66, and the plane of rotation of pinch roller 84 is perpendicular to the direction of arrow 88. Arrow 88 represents the direction of movement of a document in a downstream direction along track 20.

When the pivotal member 78 is in the first poosition shown in FIGS. 2 and 3, a document such as 18 which is placed in the receiving area 34 (with the long dimension or bottom edge of a document parallel to arrow 88) will be driven downwardly (as viewed in FIG. 2) towards the bottom 40 of the track 20 by the combined action of the disc 66 and the pinch roller 84. The motor 56 drives the disc 66 in a counterclockwise direction as shown by arrow 90 in FIG. 3. As a sheet 18 is moved downwardly, its lower edge will be detected by sensors 92 and 94 (FIG. 1) which are positioned along one side of the track 20 so as to provide a signal when the lower edge of the sheet 18 contacts the bottom 40 (FIG. 2) of the track 20. The sensors 92 and 94 are conventional, and have sources of light 96 and 98, respectively, located on the opposite side of the track 20. The sensors 92 and 94 each provide a signal when the light thereto is interrupted by the lower edge of a sheet 18. The outputs of the sensors 92 and 94 are suitably ANDed by the control logic 32 to provide a signal which energizes solenoid 100, as the sheet is now positioned with its lower edge contacting the bottom 40 of the track 20.

Figure 4:
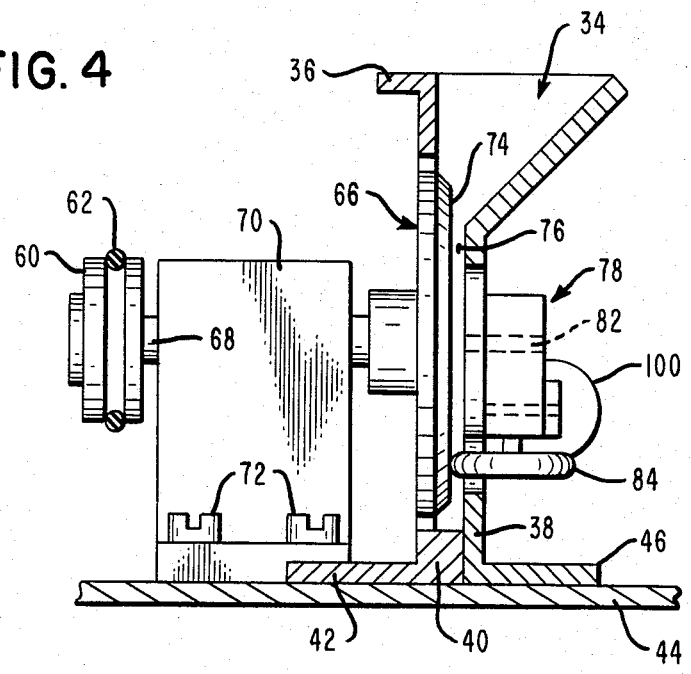
FIG. 4 is a view similar to FIG. 2 showing the drive apparatus in a second position from which a document is driven downstream in the track.
Figure 5:
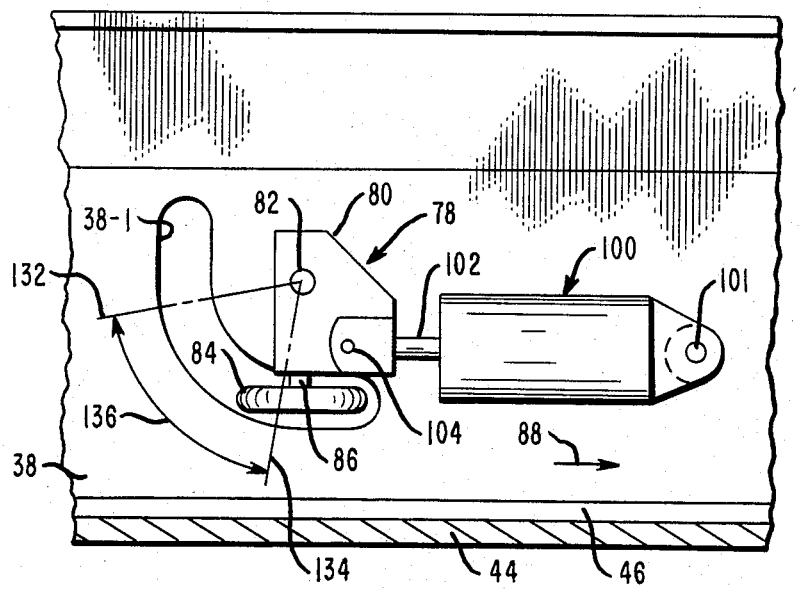
FIG. 5 is a side elevational view similar to FIG. 3, but shows additional details of the drive apparatus in the second position.

When the solenoid, 100 is energized, the pivotal member 78 is rotated or pivoted to the second position (as shown in FIGS. 4 and 5). In this second position, the roller 84 and the surface 74 of the rotating disc 66 combine to move or feed the sheet 18 in a downstream direction in track 20, as indicated by arrow 88 in FIG. 5. The side wall 38 has an arcuately shaped recess 38-1 therein to enable the roller 84 to be moved between the first and second positions mentioned.

From what has been just described, it should be noted that a document or sheet 18 is first moved downwardly towards the bottom 40 of the track 20, and thereafter, it is moved in a downstream direction (arrow 88). This orienting and then moving or feeding of the sheet 18 is accomplished within a very short distance as measured along the downstream direction so as to enable the sheet 18 to be properly oriented with the lower edge thereof contacting the bottom 40 of the track 20 when the sheet reaches the encoding station 16 (FIG. 1).

The solenoid 100 (FIGS. 3 and 5) has an operating plunger 102 extending therefrom, with the end of the plunger 102 being pivotally joined to the pivotal member 78 by a pin 104. When energized, the solenoid 100 rotates the pivotal member 78 through an angle of 90 degrees or less from the position shown in FIG. 3 to the position shown in FIG. 5. The solenoid 100 also has a compression type spring 106 (FIG. 3) therein which is compressed as the solenoid 100 is energized. The solenoid 100 itself is pivotally joined to the sidewall 38 by a pin 101. When the solenoid is deenergized by the control means 14, the spring 106 returns the pivotal member 78 from the second position shown in FIG. 5 to the first position shown in FIG. 3. Suitable adjustable, conventional stops (not shown) associated with either the solenoid 100 or the pivotal member 78 are used to limit the rotation of the pivotal member 78 to the 90 degrees or less mentioned.

After a document 18 is moved downstream (arrow 88) by the pivotal member 78 being in the second position shown in FIG. 5, the document is moved further downstream by a conventional feed mechanism designated generally as 108 as shown in FIGS. 1 and 6. The feed mechanism 108 includes a drive roller 110 which is rotatably mounted on the side wall 36 to cooperate with a pinch roller 112 which is rotatably mounted on the side wall 38 and is resiliently biased to move towards the drive roller 110 as is conventionally done. The driving shaft 114 of drive roller 110 has a driving pulley 116 fixed thereto to be rotated by an endless belt 118 which is coupled to the driving pulley 120 of motor 122. Drive roller 110 is rotated in a counterclockwise direction (as viewed in FIG. 1) by the motor 122.

The encoder 16 (FIG. 1) usually has its own conventional feed means 124 (shown as a drive roller) associated therewith to move the sheets like 18 at the appropriate rate to effect encoding of the sheet at the encoder 16. The feed mechanism 108 shown in FIGS. 1 and 6 is of the "soft" variety which means that the coefficient of friction between the drive roller 110 and the pinch roller 112 is such as to enable drive roller 110 to rotate or "slip" on the surface of sheet 18 as, for example, the feed means 124 at the encoder 16 moves the sheet 18 at the encoding rate of encoder 16 which usually is slower than the feeding rate provided by drive rollers like 110.

A conventional printer control (FIG. 7) is used to format the data to be encoded by the encoder 16. A source of light 128 (FIG. 1) located on one side of track 20 and its associated light sensor 130 located on the opposite side of the track are used to inform the control means 14 that the trailing edge of a sheet like 18 is out of the encoder 16, and that the next sheet like 18 may be hand fed into the sheet receiving area 34 (FIG. 1) to repeat the process as described. The encoder 16 may have its own sensors (not shown) similar to sensor 130, for example, which are positioned along the track 20 to detect the leading edge, for example, of a sheet 18 thereat so as to initiate the encoding or printing. Because this aspect is conventional, it need not be described in any further detail.

In the embodiment described, the disc 66 has a diameter of 48 mm. and it is rotated at a velocity of 600 revolutions per minute. The roller 84 is positioned at a radial distance from the pin 82 (FIG. 3) so as to effect a downward velocity (towards the bottom or third wall 40) of approximately 1200 mm. per second, and a downstream velocity along the direction of arrow 88 at the same velocity. The inch roller 84 pushes a sheet into engagement with the surface 74 of the disc 66 while the pivotal member is in said first and second positions and while the pivotal member 78 is moved from the first to the second position. The roller 84 is made of a plastic material like urethane, and the surface 74 of disc 66 is made of a plastic material such as polyurethane to minimize static electricity discharge problems. Naturally, the velocities and materials can be changed to suit particular applications.

In some applications, it may become necessary to change the locations of some of the elements included in the apparatus 10. For example, when space requirements dictate, the solenoid 100 may be moved from its location shown in FIG. 5 to a location in which it is mounted on the baseplate 44 with suitable conventional linkage connecting it to the pivotal member 78. Also, while the spring 106 in FIG. 3 is shown as a compression type spring, a torsional spring (not shown) positioned, for example, around pin 82 in operative association with the pivotal member 78 may be used to return it to the first position mentioned. The pivotal member 78 is described as being pivoted up to 90° between the positions shown in FIGS. 3 and 5 so as to provide a maximum downward thrust of a sheet 18 prior to moving it in a downstream direction. However, the adjustable stops (not shown) associated with the pivotal member 78 may be located so as to limit the movement of the pivotal member 78, for example, between a first position shown by dashed line 132 in FIG. 5, and a second position shown by line 134. When the pivotal member 78 is in the first position represented by line 132, the major thrust of the disc 66 and the roller 84 on a sheet 18 is downward as viewed in FIG. 5; however, there is a slight component of force to urge the sheet in the downstream direction as shown by arrow 88. If this is not objectionable in the environment in which the apparatus 10 is used, a benefit of such a modification is that the included angle 136 between lines 132 and 134 is smaller than 90 degrees and requires less time for the solenoid 100 to move the pivotal member 78 between its first and second positions to increase the sheet feeding rate. The included angle 136 may be about 70 degrees in such a situation, and the line 132 is located about 10 degrees from a horizontal line as viewed in FIG. 5.

I claim:

1. A sheet moving apparatus comprising:

a track having first and second spaced side walls and a third wall therebetween to form a sheet receiving space therebetween; and means for moving a sheet substantially towards said third wall and thereafter moving said sheet in a downstream direction along said track, comprising:

a rotatable member having an axis of rotation and also having a surface positioned in said sheet receiving space;

means enabling said rotatable member and its surface to be rotated so that said surface is parallel to said first and second spaced walls and said axis of rotation is perpendicular thereto;

a moveable member and means enabling said moveable member to pivot between first and second positions with regard to said rotatable member;

said moveable member having an engaging member to cooperate with said surface to said rotatable member to move a sheet towards said third wall when said moveable member is in said first position and said rotatable member and its surface are rotated, and said engaging member of said moveable member being enabled to cooperate with said surface of said rotatable member to move said sheet in said downstream direction when said moveable member is pivoted to said second position and said rotatable member and its surface are rotated; and drive means for pivoting said moveable member between said first and second positions.

2. The apparatus as claimed in claim 1 in which said drive means includes an actuator to move said moveable member to said second position when said actuator is energized, and also includes a resilient means to move said moveable member to said first position from said second position when said actuator is de-energized.

3. The apparatus as claimed in claim 2 in which said moveable member has a pivoting axis enabling said moveable member to pivot in an imaginary plane between said first and second positions; and said pivoting axis being coincident with said axis of rotation.

4. The apparatus as claimed in claim 3 in which said engaging member comprises a rotatable pinch roller having an axis of rotation which lies in said imaginary plane, said pinch roller having a periphery which is positioned to engage said surface, and said pinch roller also having a plane of rotation which is perpendicular to said downstream direction when said moveable member is in said first position.

5. The apparatus as claimed in claim 4 in which said second side wall has an arcuate slot therein to enable the periphery of said pinch roller to pass through said slot to engage said surface; and in which said drive means further comprises means for sensing when an edge of a said sheet is positioned at said third wall to produce a signal which energizes said actuator to pivot said moveable member through less than 90 degrees to said second position.

* * * * *